US008366880B2

(12) United States Patent
Toubeau et al.

(10) Patent No.: US 8,366,880 B2
(45) Date of Patent: Feb. 5, 2013

(54) FIBROUS SUPPORT INTENDED TO BE IMPREGNATED WITH LIQUID

(75) Inventors: Francois Toubeau, Oullins (FR); Regis Dumont Roty, Saint Paul sur Risle (FR)

(73) Assignee: Ahlstrom Corporation, Helsinki (FI)

( * ) Notice: Subject to any disclaimer, the term of this patent is extended or adjusted under 35 U.S.C. 154(b) by 0 days.

(21) Appl. No.: 13/352,015

(22) Filed: Jan. 17, 2012
(Under 37 CFR 1.47)

(65) Prior Publication Data

US 2012/0111519 A1 May 10, 2012

Related U.S. Application Data

(62) Division of application No. 11/911,941, filed as application No. PCT/FI2006/050143 on Apr. 11, 2006, now Pat. No. 8,097,123.

(30) Foreign Application Priority Data

Apr. 18, 2005 (FR) ..... 05 50961

(51) Int. Cl.
*D21F 11/00* (2006.01)

(52) U.S. Cl. ..... 162/149

(58) Field of Classification Search ..... 162/149, 162/141
See application file for complete search history.

(56) References Cited

U.S. PATENT DOCUMENTS

| | | | |
|---|---|---|---|
| 4,300,981 | A | 11/1981 | Carstens |
| 5,048,589 | A | 9/1991 | Cook et al. |
| 5,397,435 | A | 3/1995 | Ostendorf et al. |
| 5,529,665 | A | 6/1996 | Kaun |
| 5,785,813 | A | 7/1998 | Smith et al. |
| 5,958,186 | A | 9/1999 | Holm et al. |
| 6,419,789 | B1 | 7/2002 | Yeh et al. |
| 2004/0163782 | A1 | 8/2004 | Hernandez-Munoa et al. |

FOREIGN PATENT DOCUMENTS

WO WO 2006111612 A1 10/2006

OTHER PUBLICATIONS

International Search Report for PCT/FI2006-050143, Nov. 2006.

*Primary Examiner* — Mark Halpern
(74) *Attorney, Agent, or Firm* — Heslin Rothenberg Farley & Mesiti P.C.

(57) ABSTRACT

Fibrous support intended to be impregnated, the fibers of which are formed 100% of cellulose fibers, characterized in that it presents, before creping or embossing, a wet traction strength of over 2.4 N/15 mm in the cross-machine direction, a water absorption capacity of at least 300% and contains less than 2% dry wet strength 10 agent in comparison with the dry weight of the fibers.

13 Claims, No Drawings

FIBROUS SUPPORT INTENDED TO BE IMPREGNATED WITH LIQUID

CROSS-REFERENCE TO RELATED APPLICATIONS

This application is a division of U.S. patent application Ser. No. 11/911,941 filed Oct. 18, 2007, and which is a Section 371 filing of International Application PCT/FI2006/050143, filed on Apr. 11, 2006, and published, in English, as International Publication No. WO 2006/111612A1 on Oct. 26, 2006, and claims priority to French Application No. 0550981, filed on Apr. 18, 2005. These applications are hereby incorporated by reference herein, in their entirety.

TECHNICAL FIELD

The Invention relates to the market of moist wipes commercialised especially for the cleaning of objects and surfaces such as windows, floors, furniture etc. These products are also used in hygiene for the cleaning of the skin, particularly the skin of babies, or as a make-up remover.

BACKGROUND

The moist wipes have to have a certain number of the following characteristics.

First of all, they have to have a certain softness making them pleasant to touch. A high softness, in other words a low rigidity, further increases the contact of the wipe with the surface to be cleaned.

However, it is necessary that the product is sufficiently resistant in order to avoid the tearing thereof after the liquid impregnation and manipulation by the final user under the effect of pressure and torsion phenomena. This parameter can be defined by measuring the wet strength of the support.

Consequently, these two parameters are contradictory, on the one hand the softness and on the other hand the solidity. These are generally inversely proportional (U.S. Pat. No. 6,719,862 B2 and US-A1-2005/0034826).

The third criterion, which is as essential as the other two, is the absorption criterion, that is to say the capacity of the support to absorb the liquid. The more liquid the support is capable of absorbing; the longer will be the duration of the evaporation and thus the duration of the use. In practice, the absorption capacity of the support depends especially on the porosity and the thickness thereof. These parameters can particularly be measured by the porosity TexTesT and by calculating of the "bulk" corresponding to the thickness/basis weight ratio of the support.

A number of solutions have thus been proposed aiming to fulfil all these objectives, but with more or less success.

A first solution consists of proposing nonwoven supports combining natural cellulose fibres and synthetic fibres. The synthetic fibres represent, in general, at least 30% by weight of the support. The presence of synthetic fibres creates a certain number of inconveniences.

First of all, they have an effect on the final cost of the product, which becomes particularly high. Further, they make the product non-biodegradable. Moreover, they require an impregnation treatment for allowing their binding to the cellulose fibres. However, the components of these treatments are modified by the cleaning solutions and pollute the surfaces, especially window surfaces, leaving a greasy film on them. Moreover, it is observed, especially in window cleaning, that this type of wipe glides with difficulty on the surface.

Finally, in terms of the manufacturing method, this can only be performed in a relatively slow speed, from about 180 m/min to 300 m/min. Of course, the cost of the synthetic fibres and this speed cannot be without effect on the final cost.

The solution which seemed to be the most obvious in order to eliminate all these inconveniences has consisted in substituting the synthetic fibres by cellulose fibres and thus proposing a support prepared mainly from fibres that are 100% of cellulose.

The document U.S. Pat. No. 4,725,489 describes, for example, a 100% cellulose support obtained by air laid technique. The document does not give any indication concerning the wet strength and the rigidity of the obtained support. It is however shown that the wipe has to be sufficiently closed to avoid the user to make holes in it with fingers when it is applied on the surface to be cleaned. In order to have a sufficient wet strength, it is known to a person skilled in the art specialised in the air laid technology to add a high amount of wet strength agent. In general, this wet strength agent is present in the form of latex and represents at least 15% as dry matter by weight of the support. More precisely, for 100 g of dry cellulose fibres it is necessary to introduce from 15 g to 25 g latex as dry matter, which makes the support non-biodegradable. This can be explained by the fact that in the air laid technology, the fibres are kept in suspension under individualised form so that each fibre has to be in contact with the wet strength agent. Finally, the air laid technique can, in general, only be applied to short fibres. In terms of the manufacturing method, this can only take place at low speeds from about 66 m/min to 150 m/min for a support of 50 g/m$^2$.

The Applicant itself manufactures moist wipes used especially for wiping fingers. These moist wipes, consisting 80-100% of long refined fibres, have a particularly high rigidity and strength, the latter being in practice over 3.0 N/15 mm in cross-machine direction and 7.5 N/15 mm in machine direction for basis weights of about 40 g/m$^2$-45 g/m$^2$, but having a relatively low water absorption capacity, in the order of 170%-230%. They are obtained by means of a papermaking method that consists of forming the sheet through wet production method with conventional drainage, and pressing the sheet in amount of 60 to 120 kN per linear meter till dryness of about 40%. Then the sheet is dried on cylinders, without any other pressing than the one coming from the clothing and the operational drawing conditions in different dryer sections till dryness of about 95%. Despite the lesser rigidity resulting from the creping action, these supports have limited liquid absorbing capacities, which make them incompatible products for use as moist wipes for cleaning of surfaces in which a higher absorption and softness are essential criterions.

Finally, it is convenient to mention the case of "tissues". What the American market understands by "tissue" is a product of 100% cellulose based essentially on short fibres (70%). Compared to the long fibres, the short fibres are very much appreciated because they confer the smoothness and low rigidity of the "tissue". In fact, the dry drape strength given by the short fibres is about 10 times lower than that given by the long fibres. The aimed market is one of kitchen paper, handkerchief, serviette and toilet paper, used in dry state in order to absorb liquids (US-A1-2005/0006043). The liquid absorption percentage and the combination of low rigidity and smoothness as dry are the main objects. The particularly satisfactory level of absorption oscillates between 350 and 450%. The low dry strength gives drape strength of about 4 N for "tissues" having a basis weight of 45+/−5 g with a surface of 100 cm$^2$. No matter if the tissues are impregnated before or after use, they are torn up immediately due to the low wet strength. This low wet strength results mainly from initial low dry mechanical characteristics desired for smoothness and low rigidity. This low strength results especially from the low amount of wet strength agent, which is lower than 0.2%, as described in documents US-A1-2005/0034826 and US-A1-2005/0006043.

Thus the object of the invention is to propose a 100% cellulose support or a support containing in addition to cellulose fibres also cellulose-based fibres combining smoothness, strength and absorption capacity compatible with the envisaged uses.

The second object of the invention is to develop a 100% cellulose support or a support containing in addition to cellulose fibres also cellulose-based fibres, which support would be less expensive to produce than its nonwoven counterparts based on synthetic or 100% cellulose fibres obtained by air laid technology.

Another problem that the invention proposes to solve is how to develop a support that would be biodegradable. By "biodegradable support" is meant a support, which is naturally destroyed or degraded by the bacteria present in the ground or soil.

To do this, the Applicant has provided a fibrous support intended to be impregnated with liquid and aimed to be used as a moist wipe, containing, as fibres, 100% of cellulose or in addition to cellulose fibres also cellulose-based fibres, the support being characterized in that it has, without creping, a wet tensile strength of over 2.4 N/15 mm in cross-machine direction, a water absorption capacity of at least 300% and contains wet strength agent less than 2% as dry matter, advantageously less than 1.8% as dry matter compared with the dry weight of the fibres.

The water absorption capacity is defined as follows: a test specimen measuring 10 by 10 cm square conditioned at 23° C. and 50% relative humidity is weighed. The water absorption capacity of the support is performed by immersing the initially weighed sample for 2 min into distilled water at 20° C.+/−1°. Then the sample is taken out of the water to be vertically drained for 2 min. Next, the sample is immediately weighed. The absorption percentage is calculated as follows:

$$\text{Water absorption}=((\text{drained weight}-\text{initial weight})/\text{initial weight})\times 100.$$

Considering the low proportion of the wet strength agent, the cellulose support is completely biodegradable. In practice, the wet strength agent is chosen from the group comprising the polyamine-epichlorohydrin (PAE) resins. It can be replaced by a polyisocyanate resin (Isovin resin of Bayer) free from AOX, DCP and epichlorohydrin or by any other treatment able to provide the same biodegradability and level of permanent wet strength.

In the end of the manufacturing process, contrary to conventional papermaking processes implemented for example for manufacturing finger wipes, the sheet of the invention, once come out of the drainage zone, does not pass into a press section to be subjected to a complementary mechanical drying, but it is dried directly without pressure, that is, for example, on a set of heated cylinders, or by drying by hot through-air on one or several perforated cylinders. When proceeded this way, a sufficiently porous and thick support is obtained to have a water absorption capacity of at least 300% compatible with the envisaged uses, a support able to be manufactured at higher speeds, over 400 m/min.

In practice, before creping and embossing, the support has a bulk of between 3.2 and 3.8 (100 kPa 2.2 $cm^2$), a TexTesT porosity of between 80 $L/m^2/s$ and 400 $L/m^2/s$, and a tensile wet strength over 2.4 N/15 mm in cross-machine direction, this value corresponding to about 30% of the dry value in cross-machine direction for a basis weight of at least 40 $g/m^2$, without upper limit.

According to a first characteristic, the fibrous support contains both short fibres and long fibres.

To enhance the water absorption capacity and to decrease the rigidity at the maximum, the short fibres have a medium arithmetic length, which is in practice between 0.5 and 0.72 mm and they represent from 40 to 60%, advantageously from 50 to 55% by weight of the total mixture of fibres. These fibres are preferably non-refined.

In practice, each short fibre gives a porosity TexTesT level of at least 15+/−5 $L/m^2/s$, advantageously more than 110 $L/m^2/s$ when an 80 g support consists exclusively of this non-refined short fibre.

In an advantageous embodiment, the short fibres are formed of a mixture of Sappi saiccor 92 and eucalyptus pulp of Sodra gold type.

In another embodiment, part or all short fibres may be replaced with non-refined long fibres. Preferably, the dry tensile index of these non-refined long fibres is below 21 Nm/g.

Advantageously, and in order to increase the water absorbency above 400%, the long fibres replacing the short fibres give a TexTesT porosity level of more than 110 $L/m^2/s$ when an 80 g support exclusively consists of this non-refined long fibre.

To enhance the wet tactile quality, the porosity and the water absorption, the fibre composition further contains non-refined viscose fibres able to represent up to 20% by weight of short fibres, advantageously from 9 to 12%.

To guarantee the desired tensile strength, the long fibres represent from 30 to 50% by weight of the mixture, advantageously from 40 to 45% and they have, in practice, an arithmetic length of between 1.2 and 1.5 mm. Advantageously, they are refined to result in the mechanical strength levels required in dry and wet state.

In accordance with a further preferred embodiment of the present invention the long fibres are refined to about 35-60°, preferably 40-55° Shopper-Riegler before mixing them with the short fibres. In a test case, refining the long fibres to 45° Shopper-Riegler gave especially good results. The refining level mentioned for the long fibres is abnormally high for obtaining the aimed mechanical characteristics, but takes into account the absence of pressing, voluntary mechanical compaction downstream of the drainage wire. However, in certain cases it is advantageous to perform an additional refining on the mixture of short fibres and long fibres. The refining degree expressed in Shopper degree will be dependent on the types of the refiners, on the quality of the lining thereof, on the pulps and on the chosen ratios. The sufficient refining degree of the long fibres or the combination of principal refining of the long fibres with the supplementary refining of the global mixture carried out before the headbox is the thing that allows reaching the porosity threshold of at least 80 $L/m^2/s$ and a dry tensile strength value so that 30% of the value corresponds to the wet strength minimum threshold of 2.4 N/15 mm in the cross-machine direction.

The invention relates also to the manufacturing method of the previously described support. The method aims mainly to get the profit out of the wet cellulose rigidity loss to provide a support that in wet state has sufficient mechanical properties and a wet drape level close to those obtained with the "tissues" in dry state and with the moist nonwovens and air laids while still guaranteeing a water absorption level of at least 300%.

According to this method, on a paper machine:

Preparing a mixture comprising water, fibres and a wet strength agent and bringing the mixture to the headbox of the machine, Forming a sheet on the draining wire, Drying the sheet directly at the outlet of the draining wire, without any preceding mechanical pressing.

To maintain the porosity level of the sheet and to reach the lowest possible dry initial rigidity, the method of the invention uses, by wet method of production, a papermaking machine without a press section downstream of the draining wire and equipped with through-air drying. Consequently, the method does not require the mechanical pressing of the sheet after its formation, thus avoiding the compaction of the constitutive fibres, which would diminish both the water absorption capacity and the smoothness of the support.

In an advantageous embodiment, the mixture of fibres is refined before sheet formation.

According to another characteristic, the production speed is over 400 m/min, in the order of 450 m/min.

The method can further comprise a supplementary creping or embossing step.

The invention and the advantages, which stem therefrom, will become more apparent from the following illustrative examples.

EXAMPLE 1

A mixture of fibres is prepared comprising:

short fibres: 59% of which:

| | |
|---|---|
| Sappi SAICCOR | 28% |
| Sodra eucalyptus | 22% |
| Viscose 6 mm | 9% |

long fibres: 41%

Nordic pine refined to a Shopper degree of 45° SR type Hercules SLX2 epichlorohydrin resin, the dry solids content of which is 12.6%, is applied 12% in relation to dry weight of fibers, corresponding to about 1.5% epichlorohydrin resin as dry matter in relation to dry weight of fibers.

The sheet is formed on the wire of the papermaking machine. Then the sheet is dried directly on two perforated "Yankee" cylinders with the help of hot through-air drying until dryness of 96% is obtained.

The characteristics of the obtained support are the following based on a basis weight of 45 g/m$^2$:

Water absorption>300% (time of soaking into the water 2 minutes and drainage time of 2 minutes)

Wet strength: 2.6 N/15 mm in the cross-machine direction and 3.3 N/15 mm in the machine direction Porosity TexTesT (min)>100 L/m$^2$/s Dry strength in cross-machine direction (min)>8.6 N/15 mm Wet drape (impregnated to 300% by weight of the water)<5N

EXAMPLE 2

Another mixture of fibres is prepared comprising short fibres: 59% of TL acacia prime long fibres: 41% Nordic pine refined to a Shopper-Riegler degree of 45° SR type Hercules SLX2 epichlorohydrin resin, the dry solids content of which is 12.6%, is applied 12% in relation to dry weight of fibers, corresponding to about 1.5% epichlorohydrin resin as dry matter in relation to dry weight of fibers.

Results comparable to those of example 1 were reached.

EXAMPLE 3

In this example, the characteristics of the prior art products are compared with those of the wipe of the invention.

Composition of the product having basis weights of between 40 g and 50 g

| Air laid cellulose wipe | Nonwoven wipe | Finger wipe | Tissue | Support of the invention |
|---|---|---|---|---|
| 100% short cellulose fibres | Mixture of cellulose and synthetic fibres | 80-100% long refined cellulose fibres | 100% of cellulose fibres, short fibres predominant | Mixture of short and long cellulose fibres |
| single-ply 12-25% of latex embossed >55 g | single-ply 4-15% of latex >38 g | single-ply <2% dry of PAE-resin creped >38 g | multi-ply <0.7% dry of PAE-resin | single-ply <2% dry of PAE-resin non-creped >38 g |

Characteristics of products having basis weights of between 40 g and 50 g

| | Air laid wipe 62 g | Non-wovens 37 g | "Finger wipe"-type wipe Creped 40 g-50 g | Multi thickness tissue 40 g-50 g | Support of the invention 39 g-50 g |
|---|---|---|---|---|---|
| Wet strength ST N/15 mm | 3 | 6 | 3.6 | 0.5 | 2.6 |
| Strength of the wipe during hand cleaning | Resists | Resists | Resists | Multiple tear & pilling | Resists |
| Wet strength ST/ dry strength ST | 51% | 70% | 26% | 11%-19% | 30% |
| Dry breaking load Cross-machine direction N/15 mm | 5.8 | 8.5 | 14 | 3.2 +/− 1 | 8.6 |
| Water absorption % | 700 | 517 | 170 | 346 | >320 |
| Porosity TexTesT L/m$^2$/s | 1290 | 3030 | 10 | 270 | 250 |
| Biodegradability | no | no | yes | yes | yes |
| Klemm index 600 s machine direction | 99 mm | 62 mm | 39 mm | | 120 mm |
| Capillary rise speed | | | | | |
| t drape | 2.1 | 2.6 | 3 | cannot be measured | <5N |
| Dry drape | 14 | 5.5 | 10 | 4 | <20 |
| Bulk | 4.29 | 3.5 | 2.7 | 2-4.2 | 3.5 |

Water absorption test: before the water absorption capacity evaluation test of a support measuring 10 by 10 cm square, the support is conditioned at 23° C. and 50% relative humidity and then is weighed. The water absorption capacity of the support is defined by immersing the initially weighed sample for 2 min into distilled water at 20° C.+/−1°. Then the sample is taken out of the water to be vertically drained for 2 min.

Then the sample is immediately weighed. The absorption percentage is calculated as follows:

Water absorption=((drained weight−initial weight)/initial weight)×100.

Klemm index: before the capillary rise evaluation test of the water ascending in the machine direction of the support, the paper strip, the dimensions of which are 15 mm in cross-machine direction and 197 mm in the machine direction, is conditioned at 23° C. and 50% relative humidity. Then the strip is vertically suspended so that 10 mm of the suspended strip is immersed into water. The height to which the water has arrived by capillary rise is measured at the end of 10 min. This height determines the klemm level. This test is carried out in an environment air-conditioned to 23° C. and 50% relative humidity.

Measuring of dry or wet drape: a steel plate of 2 mm is provided, in the centre of which there is a hole having a diameter of 39 mm so that the hole is centred under a metallic cylindrical shaft, the length of which is at least 10 cm and the diameter of which is 31.5 mm. This shaft is attached to a casing connected to a traction device programmed into a compression mode. The distance between the vertical shaft and the hole plate is at least 10 mm. The dry or wet sample measuring 10 cm by 10 cm is centred on the plate. The shaft is allowed to descend with a speed of 300 mm/min and it is stopped when it has covered a distance of 10 mm under the plate. The sensor gives information of the strength of the paper to be conformed in shape to the shaft in order to get into the hole. This strength is the drape expressed in Newton.

Measuring of the biodegradability: half of the length of a series of 6 test specimen are laid down on an agricultural soil layer approximately 4 cm thick and then covered by a soil layer approximately 1 cm to 1.5 cm thick. Afterwards, the uncovered part of each specimen is laid down on the soil covering the buried part. The soil is contained in a planter 28 cm×43 cm and 8 cm high. The bottom of the planter has 8 open semi cylindrical cavities 10 mm deep. The cavities that are perpendicular to the 43 cm sides and the planters center are 6.5 cm×1.5 cm and the cavities perpendicular to the 28 cm sides and the planter's center are 16 cm×1.5 cm. Each cavity is perforated by a hole of 7 mm diameter. Only the 4 cavities between the planter's corner and its center measure 12 cm×1.5 cm are perforated by two holes of 7 mm each. The holes are located closer to the planter's sides for the cavities having one single hole. For the cavities containing two holes, the 7 mm diameters apertures are located on both sides of the each cavity. Each hole is designed to allow water to get inside the planters and is especially designed to prevent the soil to escape. The planter is laid down in a tray measuring 30 cm×46 cm and 3 cm height. Once the test specimen are half way buried in the above manner, the tray is half way filled with tap water and the planter is covered by a transparent cup 12 cm high. The cup is designed to prevent the moisture to escape from the planter during the biodegradability test. Before storing the tray with the planter in a humidity chamber conditioned at 23° C. and 70% RH, the package weight is monitored. The planter on its tray must remain in the climatic chamber as long as any specimen part remains visible. Once per week, the planter on its tray is removed in order to examine the test specimen. During the biodegradability test, nothing can be removed from the planter. When necessary, free the buried part with extreme caution in order to ascertain that the buried part has been fully destroyed by the bacteria. A material is considered fully biodegradable when it has entirely disappeared from the planters 3 months later maximum. If necessary, report what remains visible inside the soil and at its surface. During the biodegradability test, the planter's weight on its tray is approximately maintained by keeping the water level in the tray at its initial level.

Permeability TexTesT of pulps (l/m$^2$/s at 200 Pa): given values based on 80 g hand sheets produced and dried with a Frank apparatus type 853.

The invention claimed is:

1. Method of manufacturing a moist wipe,
the method comprising the steps of:
preparing a mixture comprising water, refined long cellulose fibers having an average length of between 1.2 mm and 1.5 mm, non-refined cellulose or cellulose-based fibers having an average length of between 0.5 mm and 0.72 mm, and wet strength agent,
bringing said mixture to the headbox of a paper machine,
forming a sheet on a draining wire of the paper machine,
drying the sheet directly at an outlet of the draining wire, without any previous mechanical pressing, and
impregnating the sheet with liquid for forming a moist wipe.

2. Method according to claim 1, further comprising adding cellulose-based fibers in said mixture of cellulose fibers and the wet strength agent.

3. Method according to claim 1, wherein said cellulose fibers include short and long fibers, of which the long fibers are refined before the sheet formation.

4. Method according to claim 1, further comprising refining the long fibers to above 35° Shopper-Riegler.

5. Method according to claim 1, further comprising refining the mixture of fibers before forming the sheet.

6. Method according to claim 1, further comprising drying the sheet by through-air.

7. Method according to claim 1, wherein a forming speed is at least 400 m/min.

8. Method of manufacturing a moist wipe,
the method comprising the steps of:
refining long cellulose fibers to above 35° Shopper-Riegler, said long cellulose fibers having an average length of between 1.2 mm and 1.5 mm,
preparing a mixture comprising water, the refined long cellulose fibers having an average length of between 1.2 mm and 1.5 mm, non-refined cellulose or cellulose-based fibers having an average length of between 0.5 mm and 0.72 mm, and wet strength agent,
bringing said mixture to the headbox of a paper machine,
forming a sheet on a draining wire of the paper machine,
drying the sheet directly at an outlet of the draining wire, without any previous mechanical pressing, and
impregnating the sheet with liquid for forming a moist wipe.

9. Method according to claim 8, further comprising adding cellulose-based fibers in said mixture of cellulose fibers and the wet strength agent.

10. Method according to claim 8, wherein said cellulose fibers include short and long fibers, of which the long fibers are refined before the sheet formation.

11. Method according to claim 8, further comprising refining the mixture of fibers before forming the sheet formation.

12. Method according to claim 8, further comprising drying the sheet by through-air.

13. Method according to claim 8, wherein a forming speed is at least 400 m/min.

* * * * *